US007591032B2

(12) United States Patent
Harrison

(10) Patent No.: US 7,591,032 B2
(45) Date of Patent: Sep. 22, 2009

(54) BEACH CABANA

(76) Inventor: James Harrison, 3700 Galt Ocean Dr., #1201, Fort Lauderdale, FL (US) 33308

( * ) Notice: Subject to any disclaimer, the term of this patent is extended or adjusted under 35 U.S.C. 154(b) by 80 days.

(21) Appl. No.: 11/672,391

(22) Filed: Feb. 7, 2007

(65) Prior Publication Data

US 2007/0181172 A1 Aug. 9, 2007

Related U.S. Application Data

(60) Provisional application No. 60/765,977, filed on Feb. 7, 2006, provisional application No. 60/746,793, filed on May 9, 2006, provisional application No. 60/844,740, filed on Sep. 15, 2006.

(51) Int. Cl.
*A47C 1/14* (2006.01)
*A47C 29/00* (2006.01)

(52) U.S. Cl. ..... 5/414; 5/656; 5/113; 5/8; 135/96

(58) Field of Classification Search ..... 5/414, 5/656, 110, 113, 8, 9.1, 118, 902; 135/96, 135/132, 133; 607/95
See application file for complete search history.

(56) References Cited

U.S. PATENT DOCUMENTS

| | | | | |
|---|---|---|---|---|
| 2,550,426 | A * | 4/1951 | Phillips | 5/8 |
| 3,908,666 | A * | 9/1975 | Osborne | 607/95 |
| 4,140,128 | A * | 2/1979 | Van Der Schaaf | 607/95 |
| 5,320,405 | A * | 6/1994 | Foster et al. | 297/184.17 |
| 6,095,172 | A * | 8/2000 | Trapp et al. | 135/96 |
| 7,201,442 | B1 * | 4/2007 | Decosta, Jr. | 297/184.16 |

* cited by examiner

*Primary Examiner*—Michael Trettel
(74) *Attorney, Agent, or Firm*—Robert M. Schwartz, P.A.; David W. Barman

(57) ABSTRACT

The present invention is a beach cabana that provides a central corridor between two lounge portions and a frame rotatable about an axis.

11 Claims, 16 Drawing Sheets

SECTION A–A
OF FIG.2
50
113
59
96
58
111, 97
94
55
95
56
57
110
51
53
54'

SECTION B–B
OF FIG. 2

SECTION A-A

FIG.12A
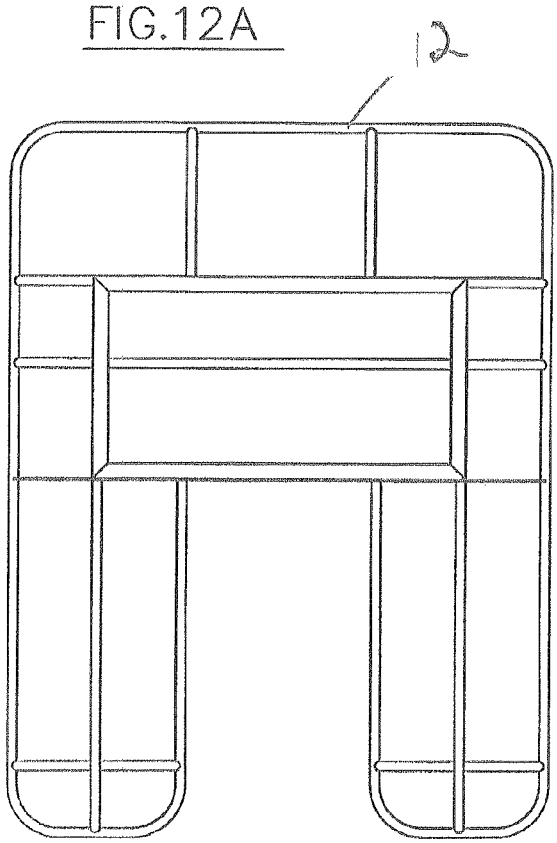
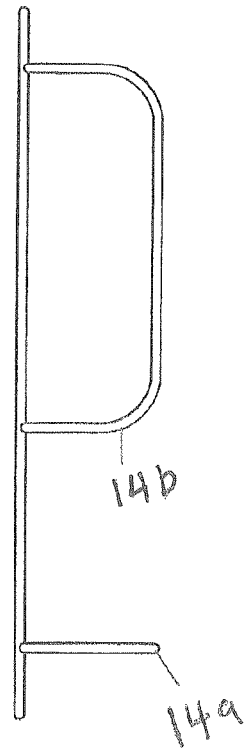
FIG.12C

BEACH CABANA

INDEX TO RELATED APPLICATIONS

This application claims benefit to U.S. Patent application Ser. No. 60/765,977 filed Feb. 7, 2006; U.S. Patent application Ser. No. 60/746,793 filed May 9, 2006 and U.S. Patent Application Ser. No. 60/844,740 filed Sep. 15, 2006 the disclosures of which are all incorporated herein by reference in their entirety.

BACKGROUND OF THE INVENTION

The recreation industry is replete with articles intended to improve the comfort and convenience of sunbathers, pool patrons, and beachgoers. The simple beach lounge has evolved into the central component of portable beach cabanas. Typically, beach cabanas are single and double units. A double unit usually includes a broad area for two persons to lounge side by side with an umbrella or canopy blocking the sun. While these cabanas have provided greater service and convenience to their users they still have shortcomings. One particular shortcoming is that a user is required to enter and leave the beach lounge portion on the outermost edges of the elongated side. Additionally current beach cabanas are large, cumbersome, and heavy when a user wants to change the orientation of the cabana for example relative to the position of the sun, it may prove to be very difficult.

The present invention addresses both of these problems. The beach cabana of the present invention provides a central corridor or passage through which the user may enter and lie down or sit on either lounge chair. Further the present invention addresses the difficulty in moving the entire cabana frame by providing a frame that is attached to a centrally positioned base wherein said base has a mechanism for easily rotating the entire frame.

BRIEF SUMMARY OF THE INVENTION

In one embodiment the present invention there is provided a novel configuration for a portable beach cabana. The cabana provides for two users to have individual lounge chair type portions. Further the configuration of the present invention has a passageway between the individual lounge chair portions and provides the ability of a person to walk in the area between the two lounge chairs.

In one embodiment the beach cabana of the present invention may be described as:

A beach cabana comprising:

(a) at least two portions for supporting a user;

(b) a passage between said portions sufficient to allow a user to pass; wherein said passage is adjacent to each of said portions.

The said portions are preferably parallel to one another. Each said portion may be a beach lounge, chair, or other desired recreational article.

In one embodiment said portions form a part of a unitary structure. The unitary structure may be a support frame.

Alternatively, the unitary structure may be an enclosure that surrounds the parallel portions that rests on the ground or upon a secondary frame.

In one embodiment, said portions are connected to a support frame.

The present invention further contemplates a support frame attached to a base.

The base of the present invention comprises a central connector. It is through the central connector that the frame is connected to a centrally positioned base.

Further, the central connector rotates independent of the base. The central connector connects to the cabana frame.

The beach cabana frame rotates with the connector. This rotation allows a user or users to easily move the entire beach cabana frame for example, so the users can position themselves and the cabana in a desired direction.

Typically the desired direction relates to the current position of the sun. Sometimes the user may wish to rotate the beach cabana frame such that they are receiving direct sunlight. Other times the users may wish to position the beach cabana frame so that they may use an attached shade to shield them from the sunlight.

The beach cabana base has a unique configuration that allows a user to rotate the beach cabana frame while the base remains in a fixed position. In one embodiment, the base comprises projections extending downward from a lower surface of the base. The projections extend from the base into and through the surface on which the base is placed. The extension of projections secures the base into a fixed position. The central connector may be rotated above the base.

Also contemplated is an embodiment of the beach cabana of the present invention that may be described as:

Also contemplated in the present invention is a novel base for use with a beach cabana.

In one embodiment, the invention provides a base comprising:

(a) a housing;

(b) a central support member;

(c) protrusions extending downward from the lower surface of said base.

The housing may be filled with matter such that said housing has an increased mass. The increased mass may be as much as 200 pounds. In a preferred embodiment the increased mass is between 10-150 pounds.

The central support member is configured so that it rotates while the base remains in a fixed position. The base protrusions extend through the surface of the area on which the base is placed. The extension of the protrusions through the surface on which the base is placed secures the base into a fixed position.

The housing may contain a region filled with matter such that the housing has an increased mass. The increased mass may include up to 200 pounds. In a preferred embodiment the increased mass is between 10-150 pounds.

BRIEF DESCRIPTION OF THE DRAWINGS

Various embodiments of the present invention are shown in the photos accompanying this application.

FIG. 12A is a top view of the cabana frame with the resting surface removed.

FIG. 12C is a partial side view of the cabana frame.

DETAILED DESCRIPTION OF THE PREFERRED EMBODIMENTS

The beach cabana 10 of the present invention provides for a single frame assembly. The frame may be made of any acceptable material such as metal, metal alloys, plastic, or other synthetic material such that the frame supports the desired weight. Acceptable material must be such that it can support the weight of lounge chairs and at least 2 adults. Preferably, the frame should be able to support 600 to 700 pounds.

Figure 1:
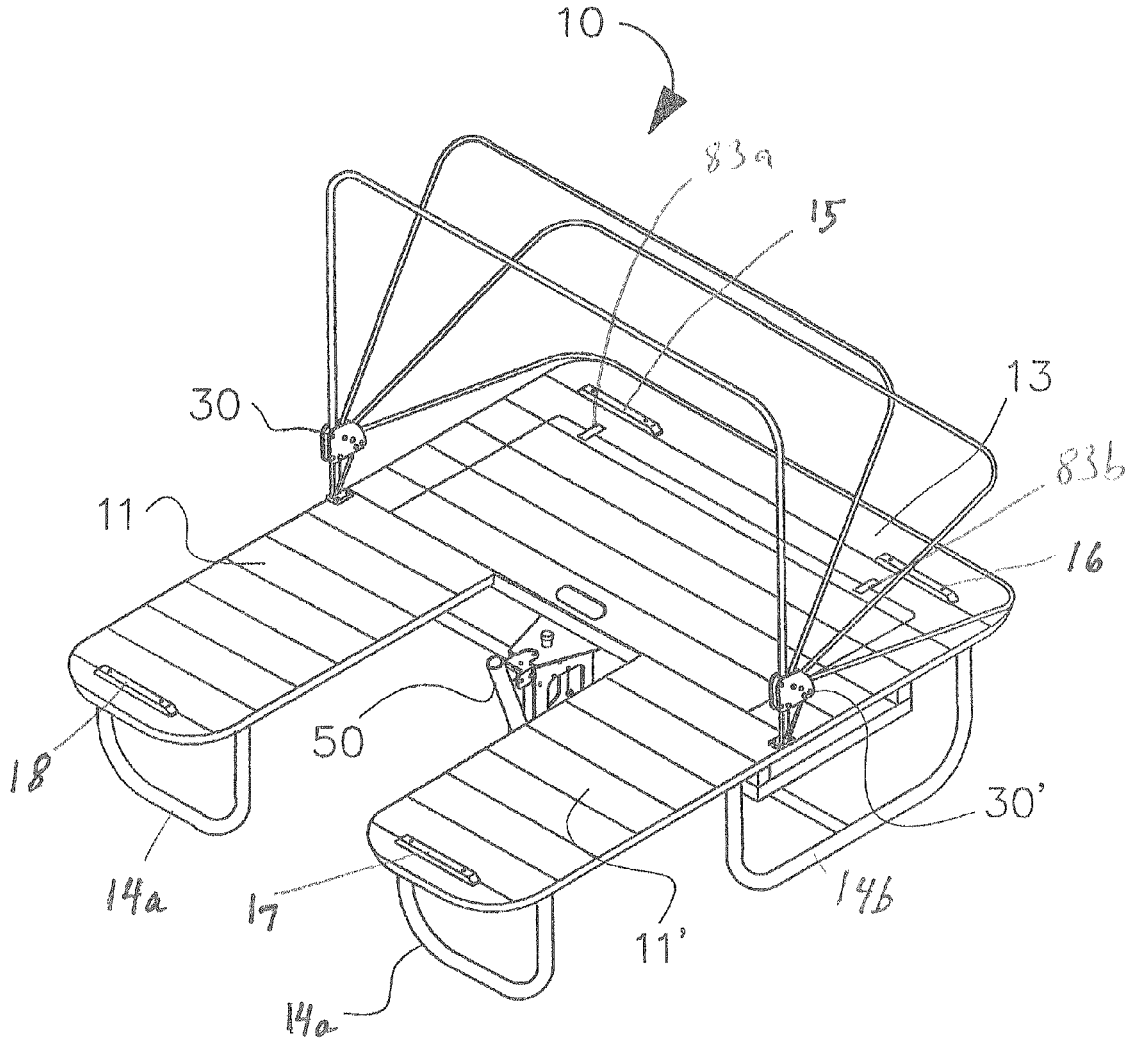
FIG. 1 is a perspective view of the entire cabana.
Figure 2:
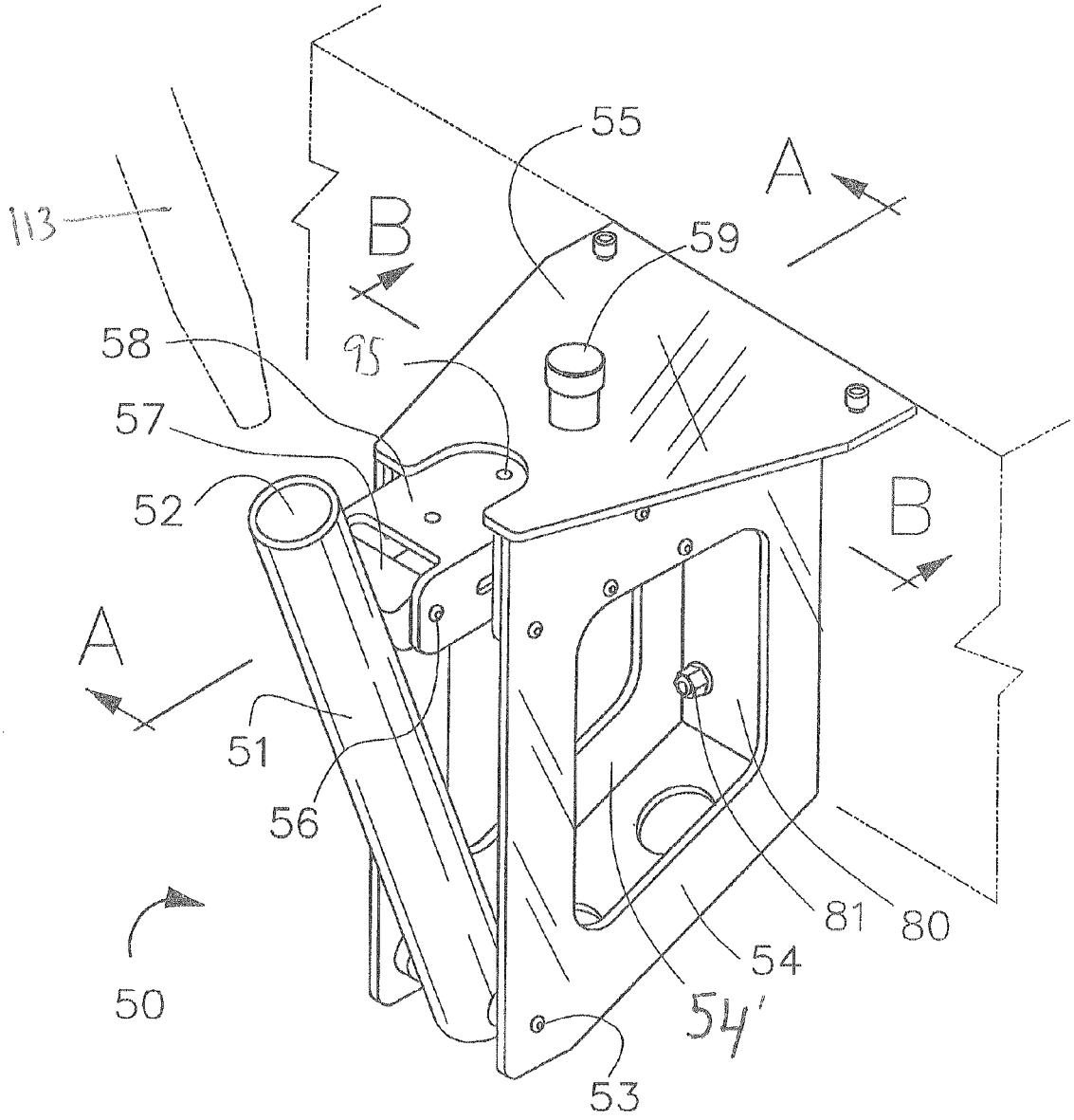
FIG. 2 is an enlarged view of the umbrella holding assembly.

In FIG. 1 cabana 10 is shown in one embodiment. Two lounge portions 11 and 11' extend outward from a platform area 13 such that the overall configuration is of a simplified squared letter "u." The area between each of lounge portions 11 and 11' forms a passage that allows a user to walk or move within the area or at least come within the cabana area in the center passage.

Figure 8:
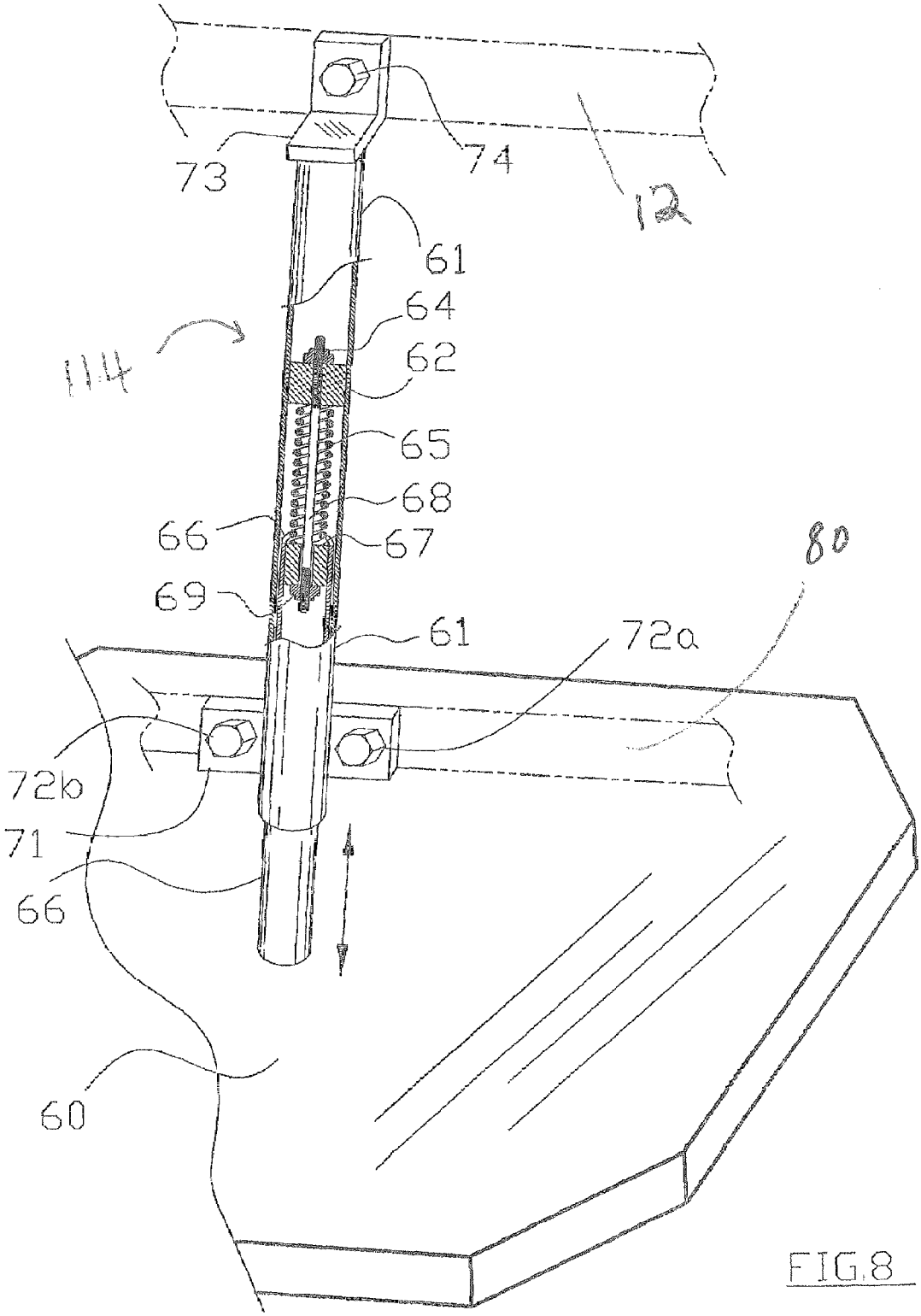
FIG. 8 is a perspective view of the spring unit, including a sectioned view of the central connector spring assembly.
Figure 9A:
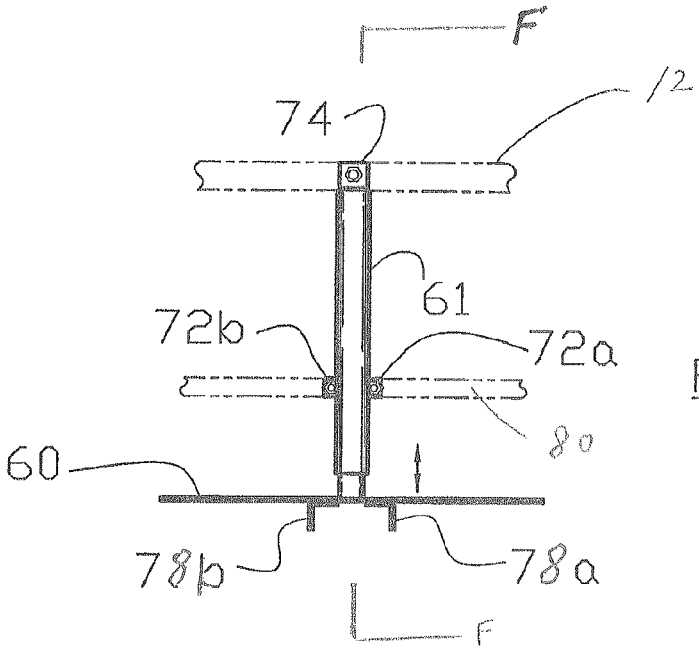
FIG. 9A is a side view of the connector rod assembly.
Figure 9B:
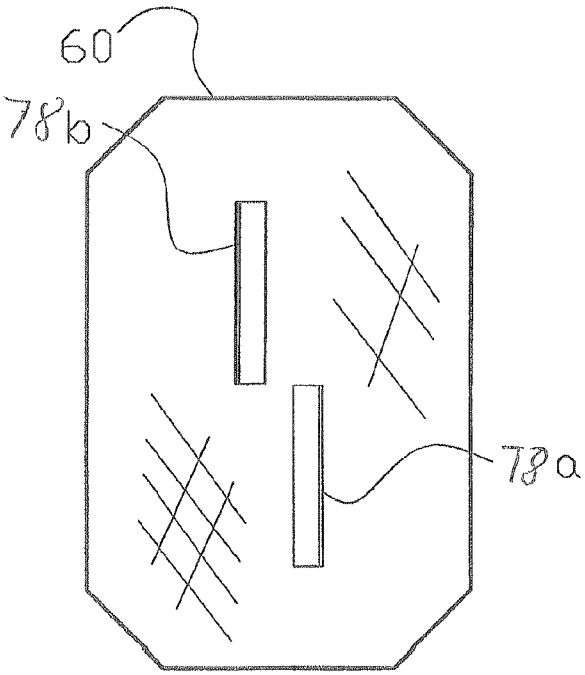
FIG. 9B is a bottom view of the base plate with stabilizing ribs.
Figure 9C:
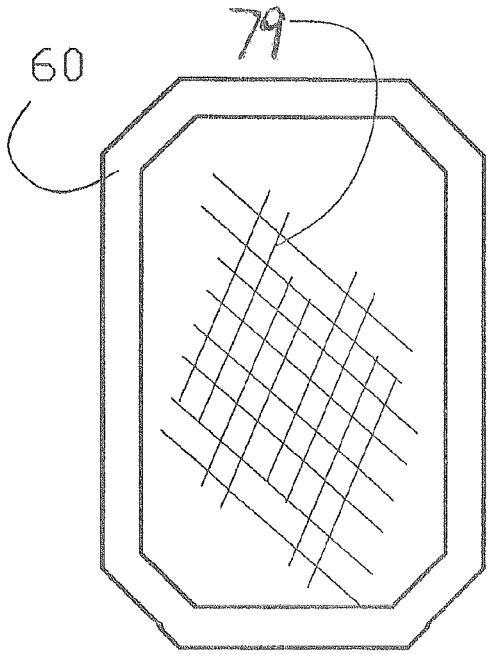
FIG. 9C is a bottom view of the base plate with a non-skid cover on the bottom surface.
Figure 10A:
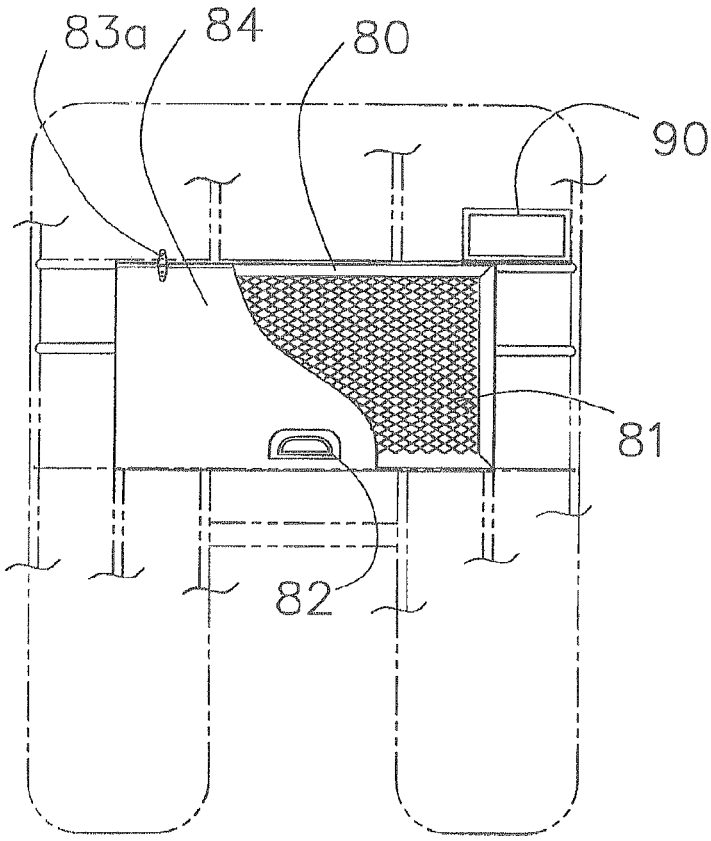
FIG. 10A is a top view of the central storage box and locking storage box.
Figure 10B:
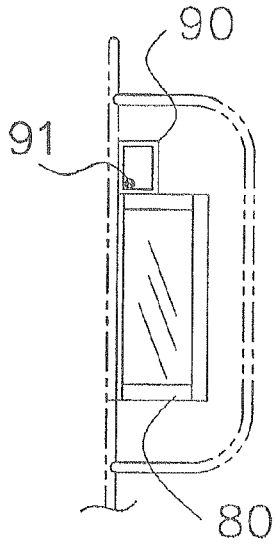
FIG. 10B is a side view of the central storage box and the locking storage box.
Figure 10C:
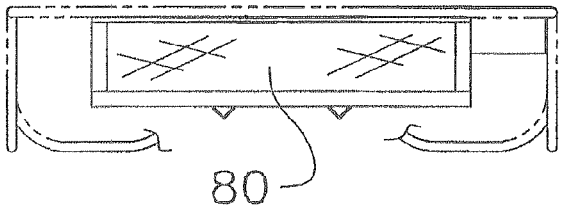
FIG. 10C is a front view of the central storage box and locking storage box.
Figure 12B:
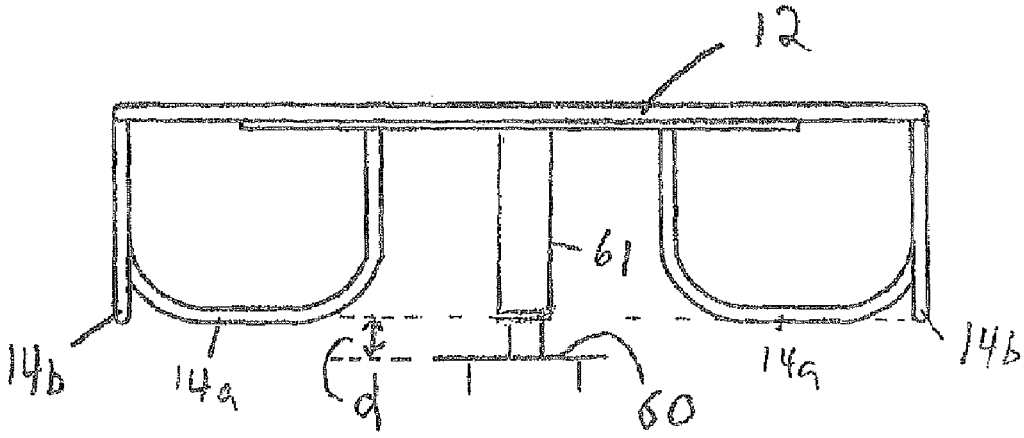
FIG. 12B is a partial front view of cabana 10 showing frame 12, central connection rod 61, and base 60, whereby frame 12 is elevated a distance d off the ground.

Unitary frame 12 includes a configuration of tubular parallel and perpendicular cross members, FIG. 12A, arranged to support lounge portions 11 and 11', and platform area 13. Portions 11, 11' and platform 13 form the upper surface 8 of cabana 10. The frame 12 parallel members and perpendicular members are generally tubular of varying diameters. Two pairs of legs 14*a* and 14*b* depend from frame 12. As seen in FIG. 9A, central connecting rod 61 is connected to frame 12 at its upper end to the lower portion of box 80 at its mid-portion and to base 60 at its lower end. Base 60 supports and is rotatably connected to connecting rod 61. Referring to FIG. 8, connecting rod 61 includes an internal spring-activated mechanism 65 to engage and disengage the rotation about the central connecting rod 61. Connecting rod 61 includes an internal spring activated mechanism 65 that raises cabana 10 a distance d (FIG. 12B) off the ground and allows for cabana 10 to rotate about the axis of connecting rod 61 when no additional weight is placed on cabana 10. Spring activated mechanism 65 is compressed when weight is placed on any part of lounge portion 11, 11' or platform area 13 and the compression of spring activated mechanism 65 lowers cabana 10 such that leg pairs 14*a* and 14*b* contact the ground and inhibit rotation of cabana 10. Typically, the spring-activated mechanism is disengaged when a person or persons sit on the cabana. When no one is sitting on upper surface of cabana 10, spring 65 engages cabana frame 12.

Connecting rod 61 lifts frame 12 off the ground, in this position frame 12 may be rotated about axis F-F (FIG. 9A) formed by central connecting rod 61. Spring 65, is a raising mechanism. The raising mechanism is not limited to a spring, but may be a gas compression cylinder or other suitable means may be used to elevate the cabana off the ground when no one is sitting on the cabana.

Figure 3:
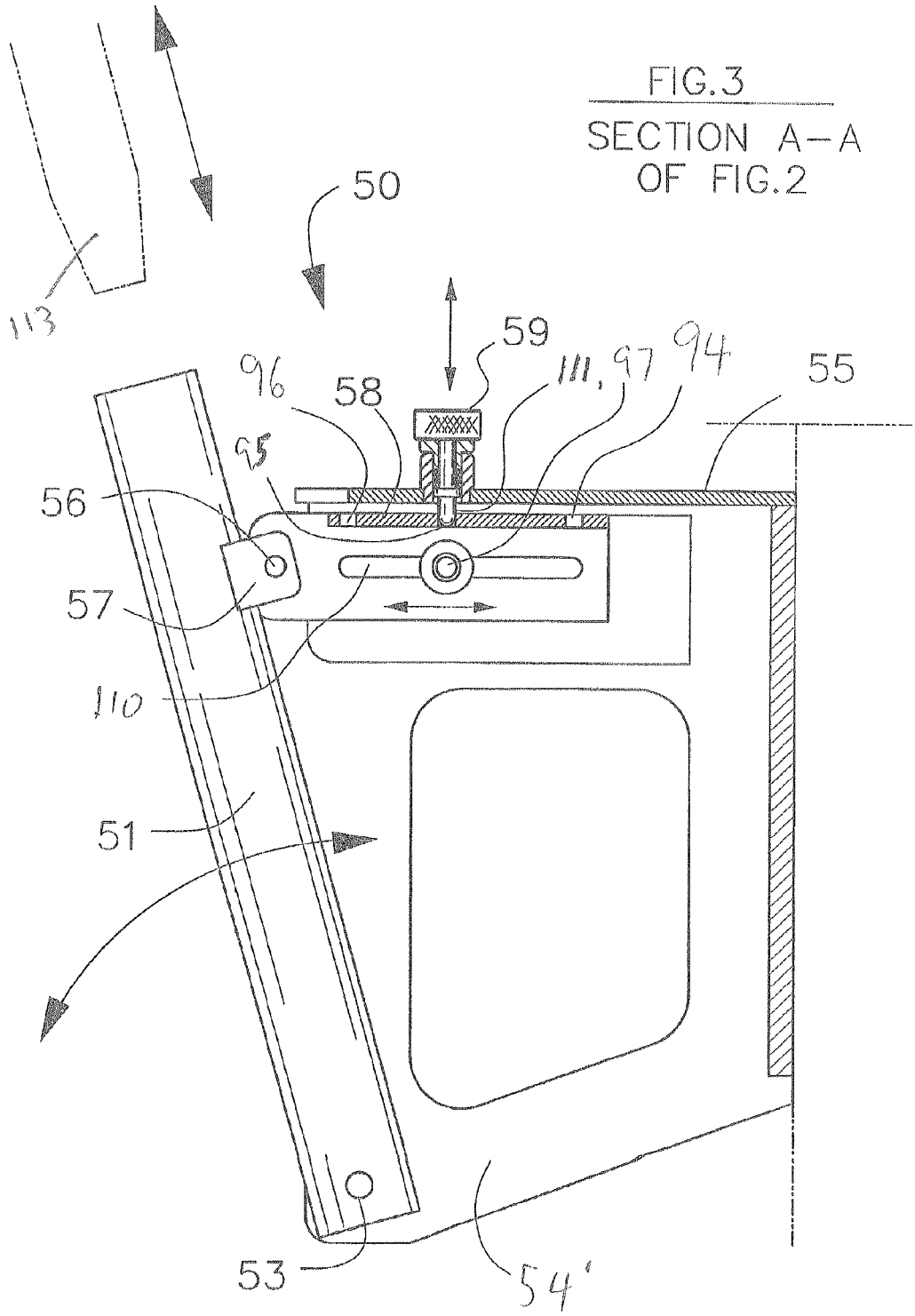
FIG. 3 is a cross sectional view of the umbrella holder assembly along lines A-A of FIG. 2.
Figure 4:
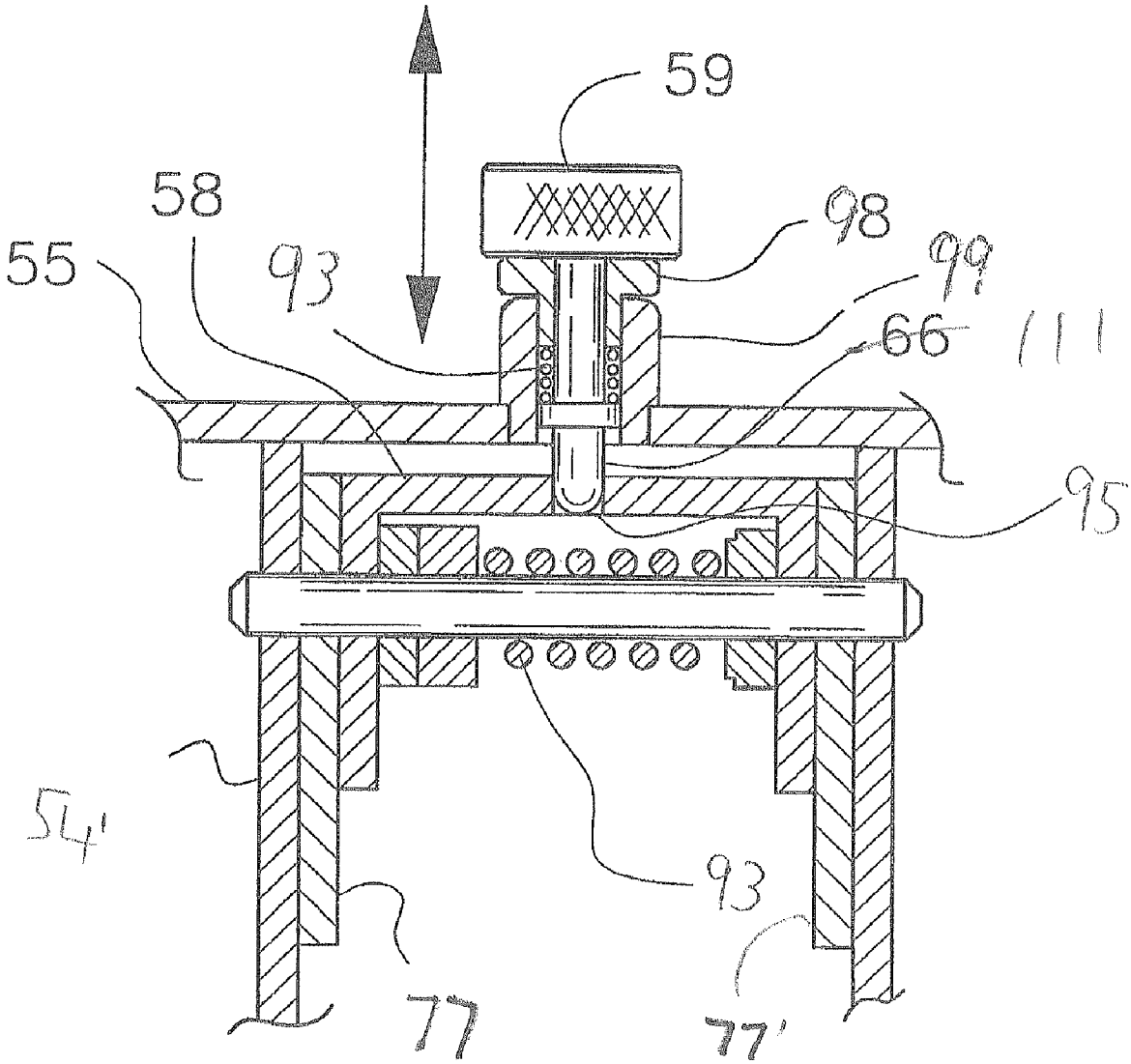
FIG. 4 is a cross sectional view of the locking mechanism in the umbrella holding assembly along lines B-B of FIG. 2.
Figure 5:
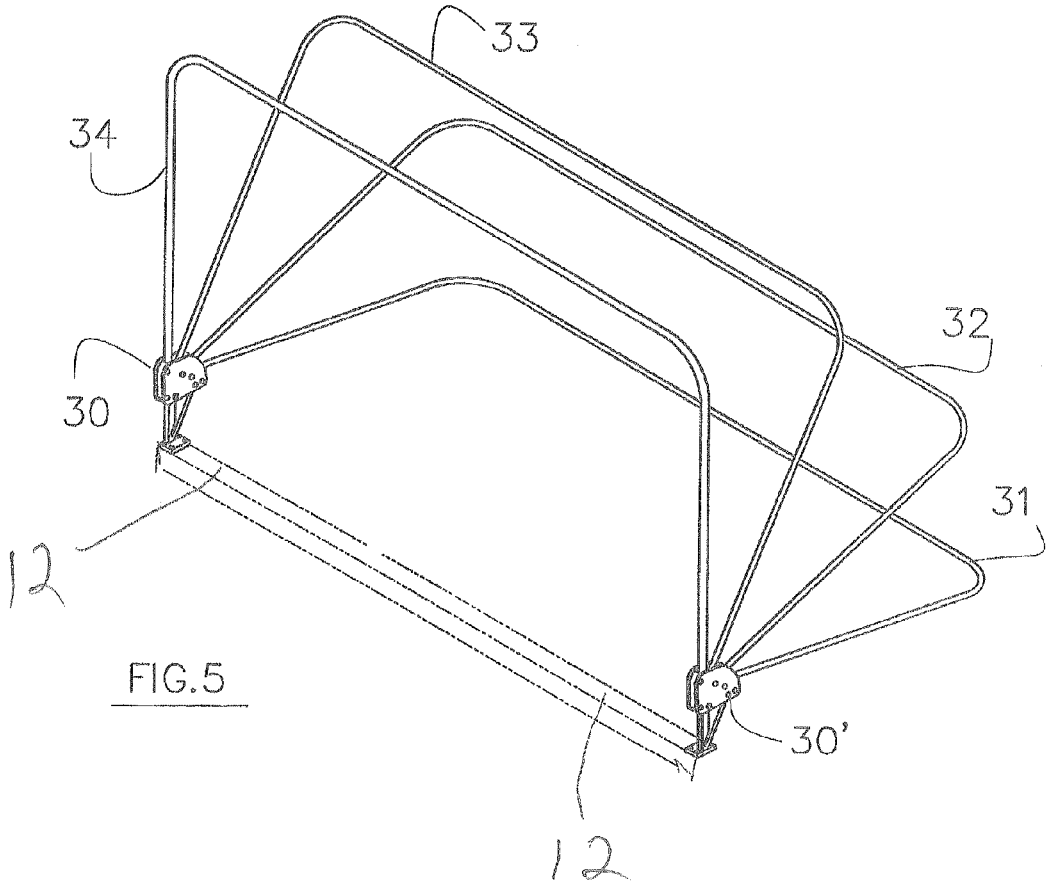
FIG. 5 is an isolated perspective view of the support arms for the canopy and rotational assembly.
Figure 6:
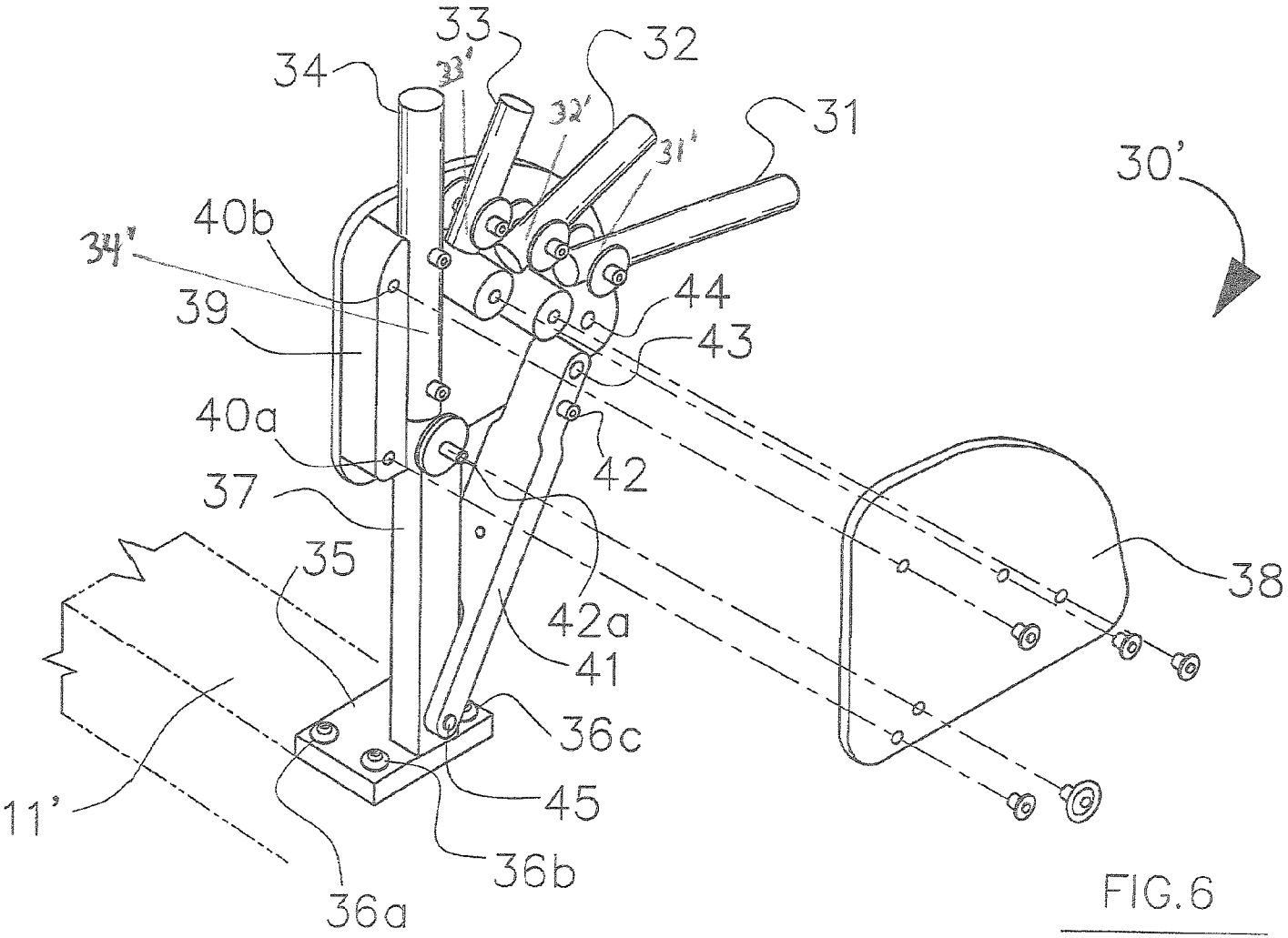
FIG. 6 is an enlarged exploded view of the support arm rotational assembly.
Figure 7B:
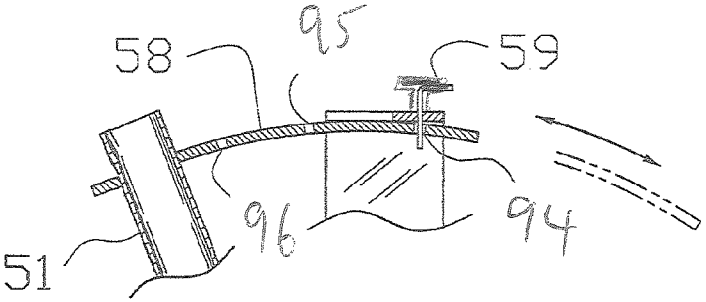
FIG. 7B is an enlarged side view of a curved embodiment of a slidable bracket for moving an umbrella socket.
Figure 7A:
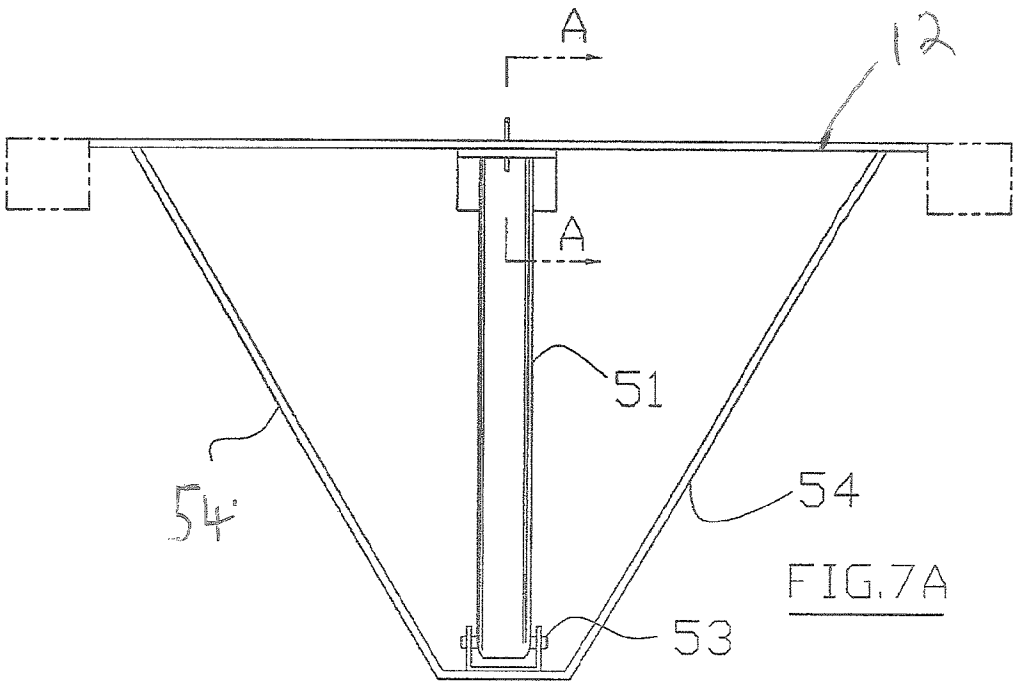
FIG. 7A is a front view of a curved embodiment of a slidable bracket for moving an umbrella socket.

Umbrella holder 50 includes umbrella socket 51 to receive umbrella 112 with umbrella pole bottom 113 bottom portion within umbrella socket cavity 52. Umbrella socket 51 is adjustable through the complementary movement of lower pivot 53 and the motion of slidable hinge bracket 58. In one embodiment, slidable hinge bracket 58 is configured with upper and lower parallel portions such that the overall configuration resembles that of a rectangular solid. In another embodiment, shown in FIG. 7A, 7B, and 7C, the slidable hinge bracket 58 as a curvature so as to extend the range of motion when the slidable hinge bracket 58 is extended away from the a perpendicular orientation. When locking plunger 59 is raised upward from umbrella housing top wall 55, the locking pin (not shown in this Figure, shown as 66 in FIG. 3, described below) disengages from one of plurality of receiving orifices (in this embodiment, 95). Housing 50 is framed on both sides by a first vertical side wall 54 and a second vertical side wall 54', and mounted to the cabana through a storage box 80 with at least one mounting nut/bolt arrangement 81.

Umbrella holder 50 is shown in cross section and shows spring activated locking plunger 59 locks into one of three receiving orifices 94, 95, or 96. Socket mounting bracket 57 is attached to socket 51 by any appropriate means. In a preferred embodiment, socket mounting bracket 57 is rigidly attached to socket 51 at one end and slidable hinge bracket 58 at its other end and socket mounting bracket 57 pivots on pivot pin 56 when is moved. Spring activated locking plunger 59 is continually urged downward towards the assembly 50 and provides an interlocking arrangement between locking pin 66 and one orifice of 94, 95, or 96. When spring activated locking plunger 59 is raised (i.e. moved in a direction away from the umbrella holder 50), locking pin 111 is disengaged from an orifice and slidable hinge bracket 58 is able to be moved where guide pin 97 limits the movement along the path of guide channel 110.

Umbrella holder assembly 50 includes a slidable hinge bracket 58 which encompasses spring activated locking plunger 59. Spring housing 99 has an inner cavity enclosing spring 93 on the interior of spring housing 99 and spring 93 urges spring activated locking plunger 59 in a downward position. Spring 93 is attached to spring activated plunger 59 through spring connection 98 that is welded and is attached to the underside of spring activated plunger 59 and the upper portion of spring 93 such that locking pin 11 interacts through the downward urging, with an orifice (94—in the shown embodiment) on the surface of slidable hinge bracket 58, such that slidable hinge bracket 58 is held in a secure and fixed position. Slidable hinge bracket 58 is further held into place by internal bracket spring 93 that urges slidable hinge bracket 58 to a perpendicular position. Internal bracket spring 93 provides tension on slidable hinge bracket 58 such that when locking plunger 59 is moved upward away from umbrella housing top wall 55 and locking pin 111 disengages from orifice 94, umbrella socket 51 does not move outward (i.e. away from the perpendicular orientation) away from housing 50 causing an undesirable fall. Slidable hinge bracket 58 is adjacent to slide plates 77 and 77' that are immediately adjacent to slidable hinge bracket 58 and provides ease and guidance for movement of slidable hinge bracket 58 when moved. In one embodiment slide plate 77 and 77' are Teflon® plates that assist in the movement of slidable hinge bracket 58. In a preferred embodiment, spring activated locking plunger 59 is raised upward from umbrella housing top wall 55 and releasing locking pin 111 and disengaging locking pin 111 from any of the openings on the surface of slidable hinge bracket 58 and allows movement of umbrella 112 held within socket 51. To move umbrella 112, spring activated locking plunger 59 is raised in the upward position and the umbrella socket 51 is manually moved from a perpendicular orientation against the tension of internal bracket spring 75 and positioned with a desired opening 94, 95, or 96 on the surface of slidable mounting bracket 58 under spring activated locking plunger 59. Once the desired opening is in position under spring activated locking plunger 59 and locking pin 111, spring activated locking plunger 59 is released, spring 93 urges spring activated locking plunger 59 downward and locking pin 111 engages the desired orifice and locks the slidable hinge bracket 58 into a fixed and desired position.

Figure 13:
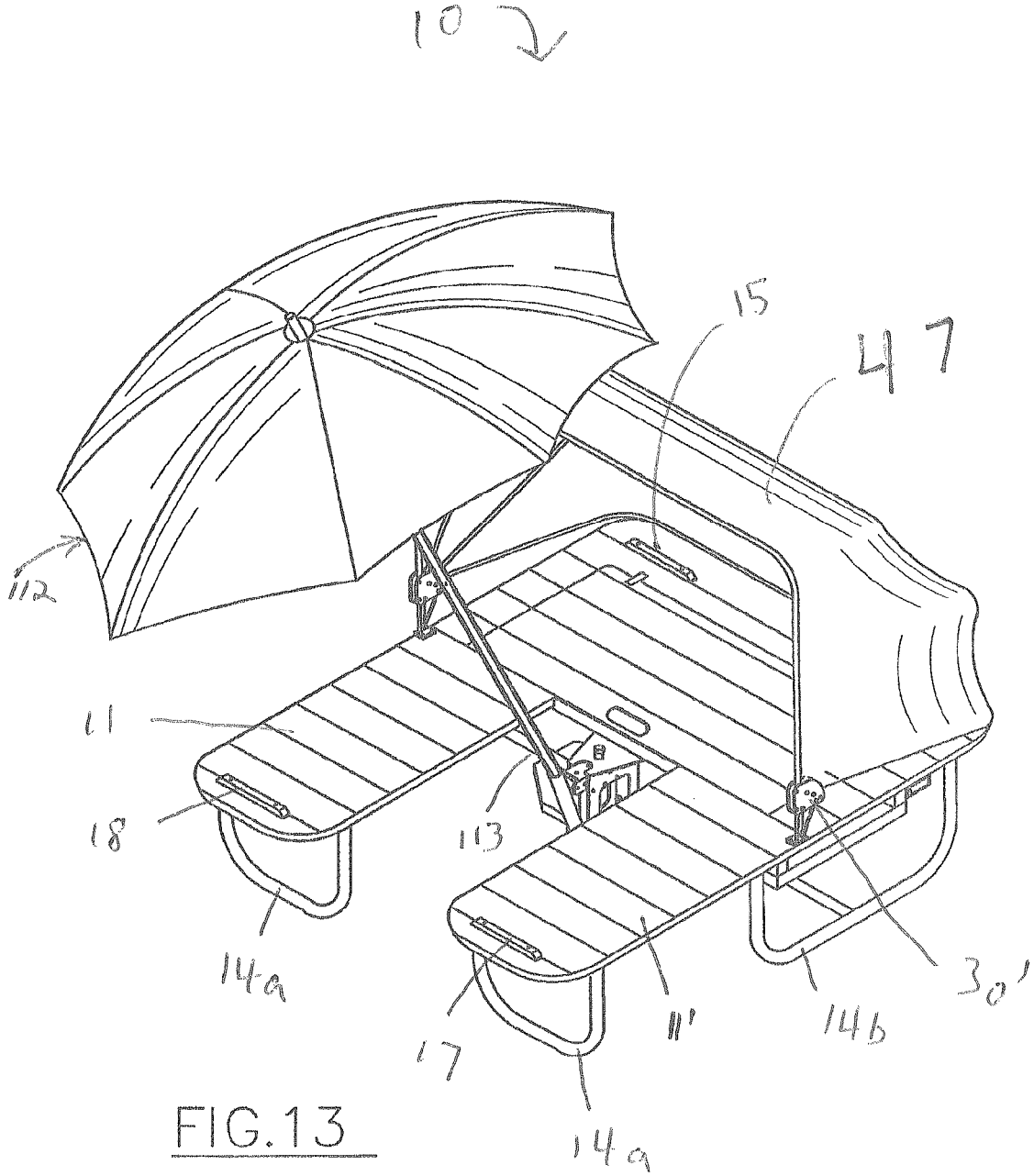
FIG. 13 is a perspective view of the overall cabana with a raised awning and an umbrella.
Figure 14:
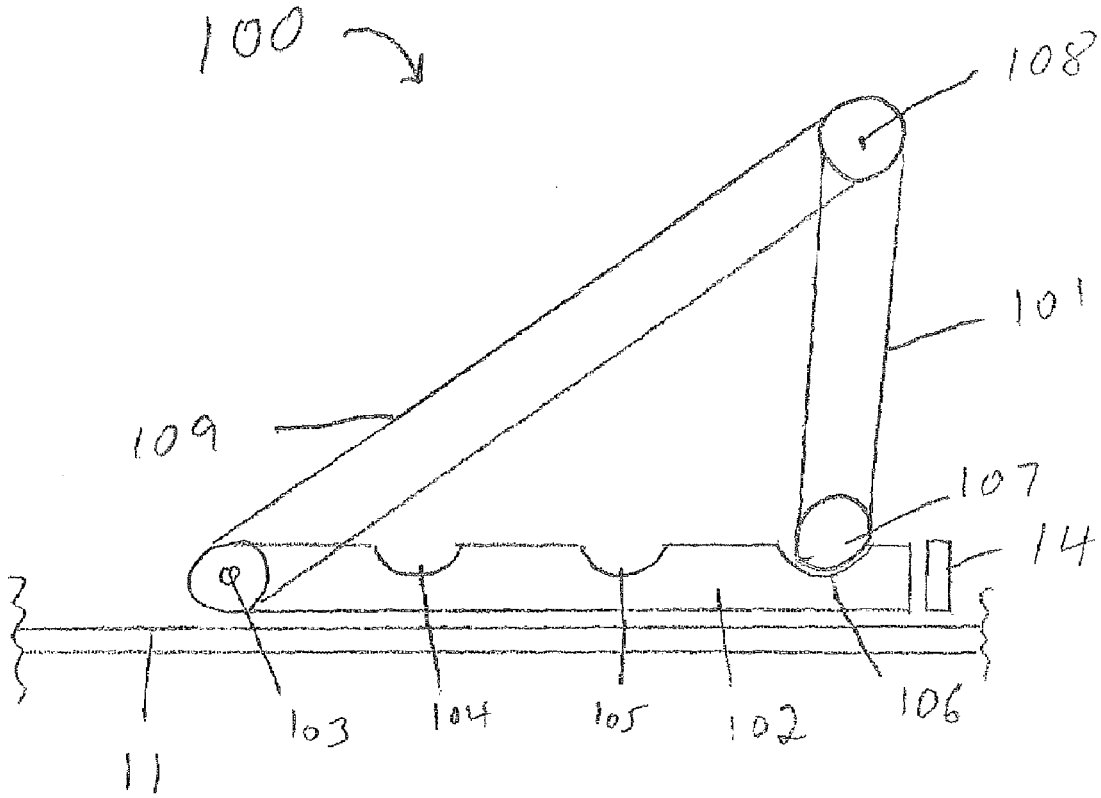
FIG. 14 is a side view of the back rest portion of the cabana.
Figure 15:
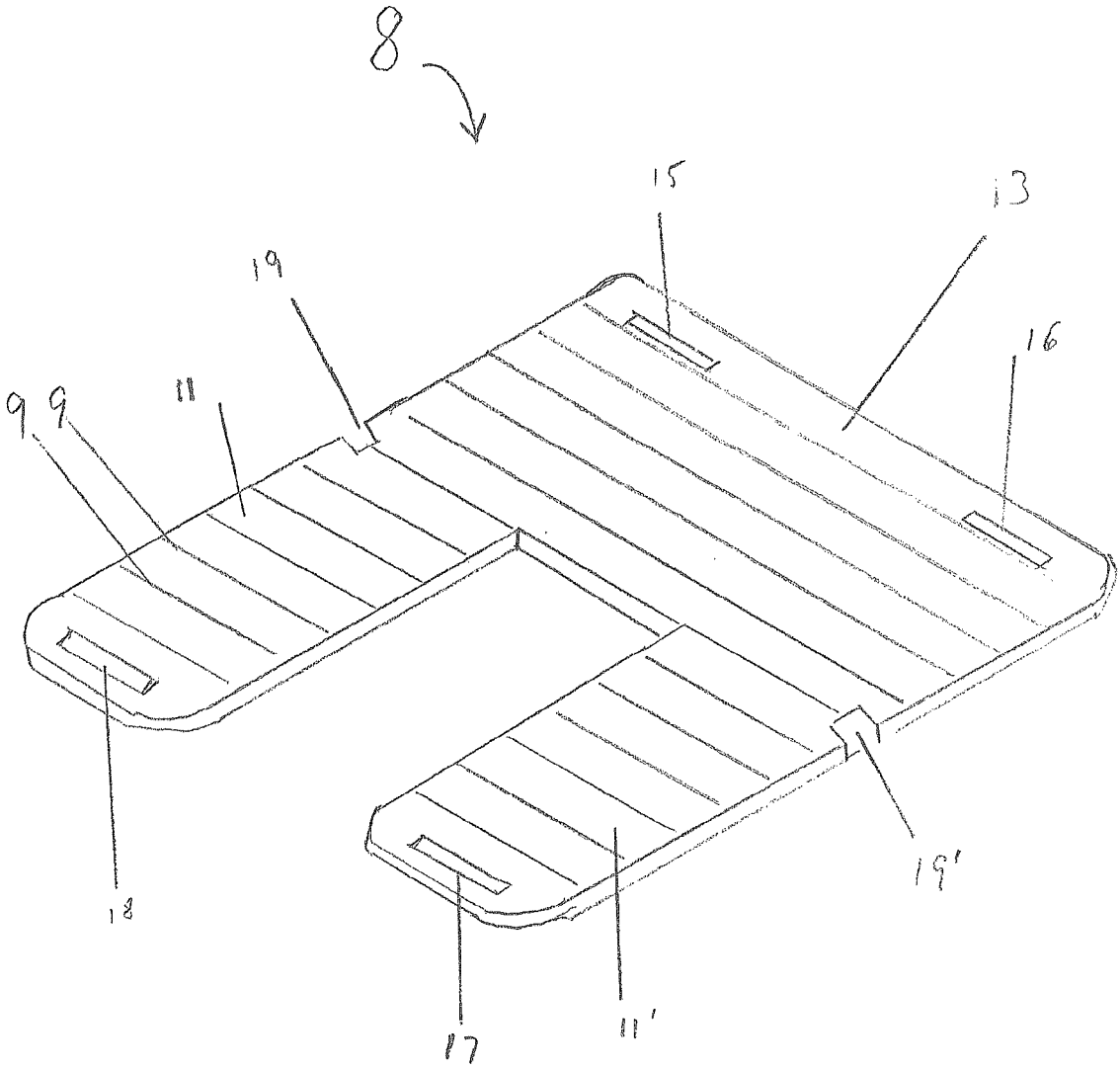
FIG. 15 is a perspective view of the cabana surface.

The Cabana awning 47 is supported by awning arms 31, 32, 33, and 34 which are pivotably supported by rotational mechanism 30 and 30'. Arms 31, 32, 33, and 34, support a cabana awning 47 (as shown in FIG. 13). Support mechanism 30', has a base 35 which, in one embodiment, mounts to the frame 12 of cabana 10 through mounting screw 36*a*, 36*b*, 36*c*, 36*d* (latter not shown) on each of the corner regions of the rectangular surface of base 35. Main support 37 extends upward from base 35 which has attached pop rod 41. Pop rod 41 pivotably attaches at the lower end of main support 37 with a dowel pin 45.

Awning rotational mechanism 30 has a pair of opposing plates 38 and 39. Exterior plate 39 is fixed to interior plate 38 by screws or other appropriate attaching means. In one embodiment each of plates 38 and 39 are secured with screws into receivers 40*a*, 40*b* and 43. Plates 38 and 39 are attached to main support 37 which is attached to base 35 and secured on the surface of each of cabana lounge portions 11 and 11'. Pop rod 41 is pivotably attached to main support 37 with dowel pin 45.

Each of arms 31, 32, 33, and 34 have a first end 31', 32', 33', and 34' pivotably attached to rotational mechanism 30' and a second end 31", 32", 33", and 34" (not shown) attached to rotational mechanism 30.

Pop rod 41 further interacts with interior plate 39 through a locking arrangement using rod locking pin 42 which may be inserted as shown, or through receiving inlet 44 and further may interact with interior plate 39 as shown or alternatively through second receiving inlet 44. Awning 47 is lowered when, as in FIG. 11, rod locking pin 42 is removed and assembly 30 rotates and subsequently lowers awning support arms 31, 32, 33, and 34 to rest on platform 13 allowing sunlight to reach the surface of the cabana.

In one embodiment the cover moves and retracts by means of 2 rotational plate mechanisms, each mechanism comprising 2 plates, located opposite one another. The rotational mechanism of the present invention represents significant improvement over previously used mechanisms in that there are no exposed areas in which people can injure themselves. The conventional mechanisms often cause injuries when fingers are caught in the movement of those devices. The mechanism of the present invention is protected within the area defined by the 2 rotational plates, and the mechanism is secured into a locked position by means of a locking pin.

Slidable hinge bracket 58 has a curvature for extending the range of motion of the slidable hinge bracket 58.

Figure 7C:
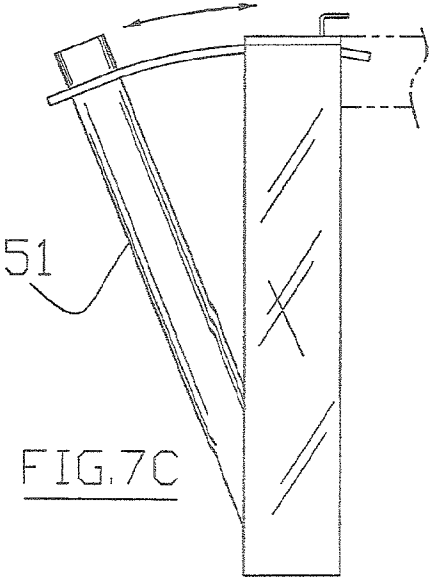
FIG. 7C is a side view of a curved embodiment of a slidable bracket for moving an umbrella socket.

Umbrella socket 51 is attached to slidable hinge bracket 58 and slidable hinge bracket 58 has an increased range of motion by way of shown curvature, when the slidable hinge bracket 58 is moved from perpendicular orientation (See FIG. 7C).

Central connector assembly 114 includes outer tube 61 and inner tube 66. Inner tube 66 is rigidly connected to base 60 by any acceptable means as is known in the art they may include, but would not be limited to a weld or a bolt. Outer tube 66 is rigidly connected to a cabana 10 through a weld to lower mounting plate 71 and lower mounting plate 71 is bolted by bolts 72*a* and 72*b* to storage box 80. Contained within the cavity of tubes 61 and 66 is a tension spring 65 that continually exerts tension in the upper and lower directions. Spring 65 exerts sufficient force such that when no person is sitting on the cabana, the spring exertion force lifts the entire cabana frame a distance "d" off the ground (depicted in FIG. 12B). Distance "d" may be varied at any distance up to about 6" by adjusting spring 65 with upper threaded bolt 64 and lower threaded bolt 69. When cabana 10 is off the ground, a user may easily rotate the entire cabana in a desired direction (e.g. toward or away from sunlight). Upper cap 62 is welded to the interior of outer tube 61 and lower cap 67 is welded to inner tube 66. Central motion rod 68 is within the interior of spring 65 and connected to upper cap 62 with upper threaded bolt 64 and connected to lower cap 67 with lower threaded bolt 69. When a person sits on the cabana, downward force is exerted on tension spring 65 and central motion rod 68 moves within a central cavity that is within each of upper cap 62 and lower cap 67 such that the entire cabana frame is lowered from a raised position and is resting on the ground. When the person gets off cabana 10, the force on tension spring 65 urges cabana 10 upward when the exerted force of spring 65 presses outer tube 61 upward and pushes against the underside of bracket 73 that is attached to the cabana frame 12 at bolt 74. Tube 61 is attached to the underside of bracket 73 by any acceptable means as is known in the art they may include, but would not be limited to a weld or a bolt (See FIG. 8).

The underside of base 60 includes protrusions 78*a* and 78*b* which extend outward from the lower surface of the base and secure the base into a fixed position and prevents base 10 from moving when cabana 10 is rotated. In an environment where cabana 10 is on a soft surface, such as grass or sand, protrusions 78*a* and 78*b* extend into the soft surface to secure base 10 into a fixed position. The protrusions extend up to 5 inches into the ground. This is advantageous because the cabana unit is substantially non-invasive on beach sand. This is compared to traditional beach umbrellas must be planted up to 2 feet through the sand in order to be stable. By extending only a few inches through the surface, the cabana of the present invention minimizes any possible detrimental effects to beach wildlife (in contrast to conventional beach umbrellas which may pierce turtle eggs or interfere with other wildlife found native on the beach—see FIG. 9A).

An alternate embodiment of the underside of of base 60 wherein said underside has a non-skid pad. The non-skid pad may be any appropriate vinyl, rubber etc. that would inhibit movement when the base and cabana are on a hard surface (e.g. cement or a pool deck).

Lid 84 of storage box 80 has hinges 83*a* and 83*b* and a handle 82. Storage box 80, has a floor 81 porously formed of either rigid or non-rigid material such that if one were to use the cabana on sand, articles that are placed within would allow sand or other particulates to pass through and not accumulate on the interior of the storage box. On preferred material is expanded metal or Jal Plate®. Also contemplated in the cabana would be a locking storage box 90 for securing valuables rigidly fixed to the underside of cabana surface 8 onto frame 12.

Figure 11:
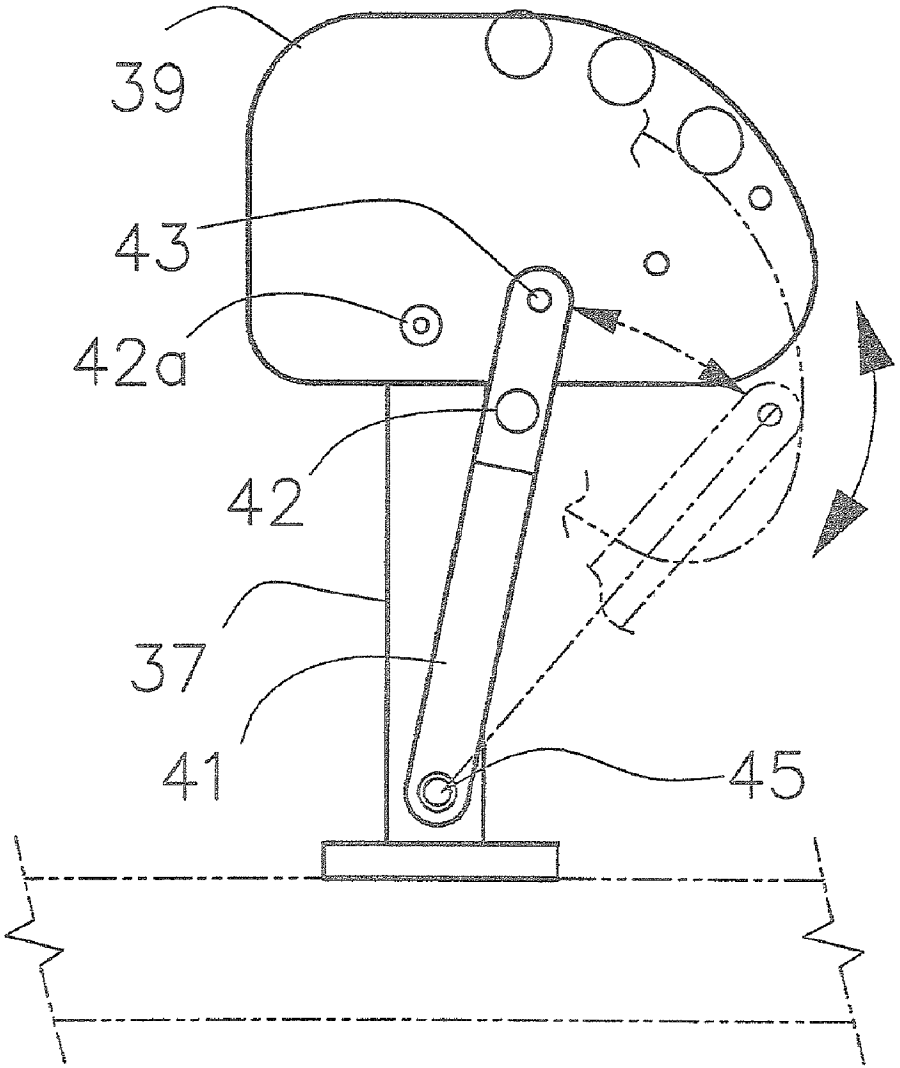
FIG. 11 is a side view of one rotational mechanism.

FIG. 11 is a side view of one rotational mechanism 30 whereby pop rod 41 is released from plate 39 when rod locking pin 42 is removed. When the pop rod 41 is removed, plate 39 rotates downward along rotational axis shown about pivot pin 42*a*. The rotation subsequently lowers awning support arms 31, 32, 33, and 34 which lowers the awning downward from the position above the cabana 10 and awning support arms 31, 32, 33, 34 rest on the upper surface of platform area 13.

FIG. 12A is a top view of the cabana frame 12 with the lounge portions and platform area removed exposing the tubular parallel and perpendicular frame members.

In FIG. 12B connecting rod 61 through urging of enclosed spring 65 is urging frame 12 upward from the ground a distance "d". The horizontal plane between leg pairs 14*a* and 14*b* is above the horizontal plan of base 60 which is resting on the ground thus the lower portions of leg pairs 14*a* and 14*b* are a distance "d" above the ground.

Figure 12D:
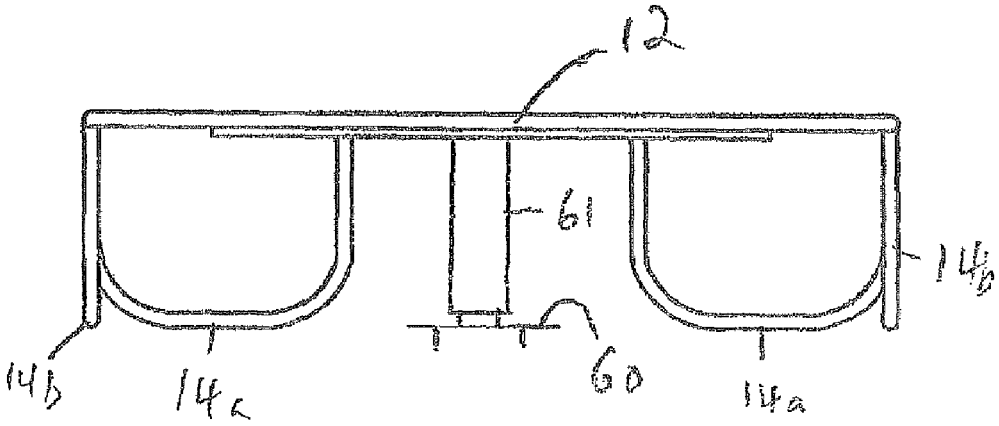
FIG. 12D is a partial front view similar to FIG. 12B, where cabana 10 frame 12 is resting on the ground such that leg pairs 14*a* and 14*b* are substantially in the same horizontal plane with base 60.

In FIG. 12D the cabana frame 12 is depicted in an orientation when weight is placed on the cabana surface 8 such that leg pairs 14*a* and 14*b* are the same horizontal plane as base 60 and each leg pair 14*a* and 14*b* contacts the ground.

FIG. 13 is a perspective view showing a cabana with umbrella and awning. The cabana has a laminate surface that is machined to shape and attached directly to the frame. A preferred material for the laminate is a high density UV polyethylene commercially available as StarBoard® from King Plastic Corporation (North Port, Fla.). In one embodiment, the laminate surface is attached using self tapping metal screws that secure through the surface of the laminate directly to the frame.

The cabana 10 has movable and adjustable back rest 100. Back rest 100 has base 102 with incorporated interlocks 104, 105, and 106 that receive a complementary terminal end 107 of adjusting arm 101.

Adjusting arm 101 is pivotably attached at arm pivot 108 to back support 109. Pivotable attachment of adjusting arm 101 may be at any appropriate location along the lower plane of back support 109. Back support 109 is on turn pivotably attached to base 102 at base pivot 103.

The cabana has lounge brackets 14, 15, 16, and 17 whereby one bracket is placed on the end of each of lounge portions 11 and 11'.

Base 102 is placed adjacent to a desired lounge bracket such that base pivot 103 is opposite the lounge bracket.

Adjusting arm 101 may be placed in a desired incorporated interlock to select the desired angle formed by base 102 and back support 109.

Movable back rest 100 allows for cabana 10 to be used in multiple configurations. Two of Back rest 100 may face the same direction, either forward or backward or back rests 100 may face opposite directions with either support facing forward or backward.

Cabana surface 8 is in the shape of a block letter "u" formed by lounge portions 11 and 11' and platform area 13. The cabana surface has incorporated ridge lines 9 to impart the appearance of a paneled assembly. The surface further has notches 19 and 19' that expose frame 12 such that awning rotational assembly 30 and 30' may be directly mounted on frame 12 at base plate 35.

In an preferred embodiment, cabana surface 8 is machine formed from a single piece of high density UW poly ethylene. The thickness of cabana surface 8 may be 0.5 inch to 1.5 inches. Cabana surface 8 is machined, cut, and curved portions formed about edge regions and ridge lines 9 formed on the surface. Notches 19 and 19' are cut to expose cabana frame 12 to allow attachment of base 35 or rotational assemblies 30 and 30'

Cabana surface 8 is attached to cabana from 12 by any acceptable means as is known in the art.

In a preferred embodiment, self tapping screws are drilled through the surface of cabana surface 8 and directly into cabana frame 12.

In an environment of use, the cabana is placed on a surface. If it is a soft or porous surface, the base of the cabana unit will have projections on the underside such that the projections extend through the upper portion of the resting surface and secures the base into a fixed position. If the cabana is placed on a hard surface, such as cement or a hard pool deck, the base will have a suitable material on the underside such that the base will not slip or be easily slid.

When not in use, the cabana unit is raised off the ground. The raising may be up to 6 inches. This allows a user to rotate the entire unit easily in a desired position. When weight is applied to the upper surface of the cabana (i.e. the lounge portions), the cabana lowers, rests on the ground, and is no longer easily rotatable.

In a preferred environment padding is placed on the upper surface of the cabana. Further, the cabana is configured such that back rests may be to elevate the upper torso at an angle, as is typical in lounge chairs. The cabana of the present invention is configured such that the back rests may each face the same direction, or opposite directions. The back rest may have both back rests facing outward toward the terminal end of the divided portions, or both may face the direction where the awning meets the surface of the cabana.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A beach cabana comprising:

(a) at least two portions for supporting a user;

(b) a passage between said portions sufficient to allow a user to pass; wherein said passage is adjacent to each of said portions; and (c) a base resting on a ground surface having a central connector rod extending upward from said base and connecting to a support frame, said support frame connecting said portions.

2. The beach cabana of claim 1 wherein said portions are parallel to one another.

3. The beach cabana of claim 1 wherein each said portion is a beach lounge.

4. The beach cabana of claim 1 wherein said portions a part of a unitary support frame structure.

5. The beach cabana of claim 1 wherein said central connector comprises an internal spring for raising said support frame off the ground when no additional weight is on either of said portions.

6. The beach cabana of claim 1 wherein said central connector rotates independent of said base.

7. The beach cabana of claim 6 wherein said support frame rotates with the rotation of said central connector.

8. The beach cabana of claim 6 wherein said base comprises projections extending downward from a lower surface of said base.

9. The beach cabana of claim 8 wherein said projections extend from the base into and through the surface on which said base is placed and secures said base into a fixed position.

10. The beach cabana of claim 9 wherein said fixed position remains fixed while a central connector may be rotated above and independent of said base.

11. A beach cabana comprising:

(a) a unitary frame connected to a centrally located base by means of a connecting rod, said unitary frame so formed as to have a central passage between two lounge chair portions;

(b) a connecting rod that has a spring-activated device that lifts said cabana off the ground when no one is sitting on said cabana;

(c) a central base that supports said connecting rod such that said cabana frame may be rotated about the axis created by said connecting rod;

(d) optionally, projections extending downward from said central base that protrude through a surface on which said cabana is residing such that said cabana may be rotated about said axis created by said connecting rod;

(e) optionally, a pivotable umbrella holder, whereby said holder is locked into position with a locking pin and is secured in either an orientation perpendicular to the ground or angular offset from orientation perpendicular to the ground.

* * * * *